United States Patent [19]

Koerkemeier

[11] Patent Number: 4,739,619

[45] Date of Patent: Apr. 26, 1988

[54] LIQUID COOLING SYSTEM FOR A TURBOCHARGED INTERNAL COMBUSTION ENGINE

[75] Inventor: Hans Koerkemeier, Achern, Fed. Rep. of Germany

[73] Assignee: Dr. Ing. h.c.F. Porsche Aktiengesellschaft, Fed. Rep. of Germany

[21] Appl. No.: 868,545

[22] Filed: May 30, 1986

[30] Foreign Application Priority Data

May 30, 1985 [DE] Fed. Rep. of Germany ..... 3519320

[51] Int. Cl.[4] ..... F02B 37/00

[52] U.S. Cl. ..... 60/605.3; 123/41.31

[58] Field of Search ..... 60/605; 123/41.21, 41.31; 417/407

[56] References Cited

U.S. PATENT DOCUMENTS 4,107,927 8/1978 Gordon et al. ..... 60/605

4,561,387 12/1985 Korkemeier ..... 60/605 X 4,608,827 9/1986 Hasegawa et al. ..... 60/605

FOREIGN PATENT DOCUMENTS 90923 5/1985 Japan ..... 60/605

*Primary Examiner*—Michael Koczo

*Attorney, Agent, or Firm*—Barnes & Thornburg

[57] ABSTRACT

A liquid cooling system for an internal combustion engine supercharged by a turbocharger which consists of a cooling circulation for the internal combustion engine through which the cooling liquid is forced by a liquid pump, and of a turbocharger cooling circulation. The turbocharger cooling circulation is formed by a pipe line from the turbocharger to a geodetically higher expansion vessel and by a return line to the turbocharger. The liquid pump is inserted into the return line of the turbocharger cooling circulation which at the same time forms the return line of the cooling circulation of the internal combustion engine.

8 Claims, 1 Drawing Sheet

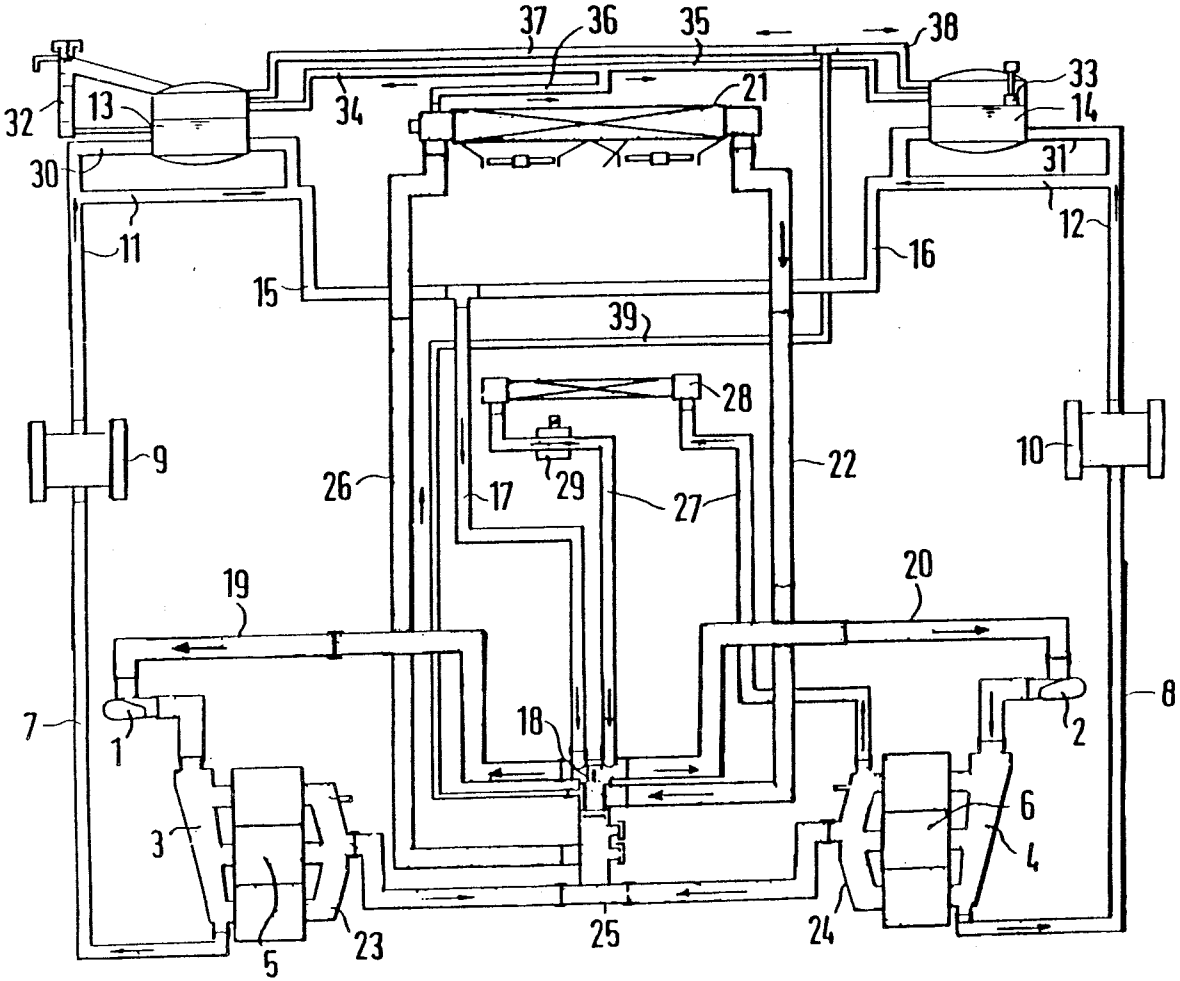
8
10
2
6
4
12
37
14
33
38
16
20
22
24
21
28
27
35
39
29
25
36
18
17
37
34
26
23
15
5
19
3
1
9
11
13
30
32
7

LIQUID COOLING SYSTEM FOR A TURBOCHARGED INTERNAL COMBUSTION ENGINE

The present invention relates to a liquid cooling system for an internal combustion engine supercharged by a turbocharger.

A cooling system of this type, as described in the German Pat. No. 34 075 21, serves to prevent a heat-up of the turbocharger after turning off the internal combustion engine and after termination of the forced flow through the cooling line. For that purpose an inlet line to a geodetically higher expansion vessel serving as heat exchanger is provided from the cooling liquid outlet connection of the turbocharger, which together with a return line from the expansion vessel to the inlet connection of the turbocharger forms a cooling circulation through which the liquid flows by thermo-siphoning action after turning off the internal combustion engine. In order to prevent a return flow through the inlet line during the forced flow through the turbocharger effected by a liquid pump, the inlet line is adapted to be closed by a check valve or a solenoid valve.

The object of the present invention resides in being able to dispense with such an inlet line through which liquid flows only during thermo-siphoning action, by a simplified pipe layout.

The underlying problems are solved according to the present invention in that the liquid pump is installed into the return line from the expansion vessel to the turbocharger. If the liquid pump is built into the return line from the expansion vessel to the turbocharger inlet connection, then the same cooling circulation can be traversed by cooling liquid by thermo-siphoning action after the liquid pump is rendered inoperable when the internal combustion engine is turned off, without the need that an additional inlet line with built-in valve structures would be required. The cooling installation becomes thereby more reliable in operation and less costly in manufacture.

These advantages become noticeable in particular with a multi-cylinder internal combustion engine of boxer-type or V-type construction, whereby one turbocharger each is coordinated to the two cylinder rows which are acted upon in a known manner by the exhaust gases and supply charging air to the cylinders. According to another feature of the present invention the return lines coming from the expansion vessel can be combined in a common return line pipe section which leads to a thermostat valve and branches off from there into two return line pipe sections to the liquid pumps. These two return line pipe sections form at the same time the return lines of the cooling circulations of the two cylinder rows.

A further advantage of this installation which is altogether of symmetrical construction, resides in that only a single central thermostat valve is necessary, by means of which the liquid flows for the turbocharger cooling circulations and the cooling circulations of the two cylinder rows of the internal combustion engine are adapted to be regulated.

These and further objects, features and advantages of the present invention will become more apparent from the following description when taken in connection with the accompanying drawing which shows, for purposes of illustration only, one embodiment in accordance with the present invention and wherein:

The single FIGURE is a schematic view of a liquid cooling system for an internal combustion engine supercharged by a turbocharger in accordance with the present invention.

Referring now to the single FIGURE of the drawing, two liquid pumps 1 and 2 supply cooling liquid into two distributor pipes 3 and 4, from where the cooling liquid is split up, on the one hand, to the cylinder rows 5 and 6 of an opposed cylinder internal combustion engine and, on the other hand, to inlet lines 7 and 8 leading to the turbochargers 9 and 10 coordinated to the cylinder rows 5 and 6. The inlet lines 11 and 12 start from the top sides of the turbochargers 9 and 10, i.e. from the outlet connections thereof. Lines 30 and 31 which are connected in parallel with the inlet lines 11 and 12, terminate in bottom parts of expansion vessels 13 and 14 for the temperature-conditioned differing liquid volume. The expansion vessels 13 and 14 are arranged at the geodetically highest place of the cooling system and are constructed as heat exchangers for cooling off the cooling liquid.

The returning lines 15 and 16 combine in a pipe section 17 which terminates in a thermostat valve 18. From the thermostat valve 18 the return flow divides into the return line pipe sections 19 and 20 to the cooling liquid pumps 1 and 2. The return line pipe sections 19 and 20 form at the same time a partial section of the return line for the cooling circulation of the internal combustion engine which starts from the outlet connection of a radiator 21 and leads by way of a pipe 22 to the thermostat valve 18 and branches off from there into the return line pipe sections 19 and 20, in which are interconnected the liquid pumps 1 and 2. The cooling water which is supplied from the liquid pumps 1 and 2 to the cylinder blocks of the cylinder rows 5 and 6, reaches collecting pipes 23, 24 and combines in the thermostat housing 25, from which an inlet line 26 leads to the inlet connection of the radiator 21.

This symmetrically constructed cooling system is able to get along with a minimum in pipe lines and offers the advantage that at the end of the forced through-flow of the cooling liquid, a thermo-siphoning cooling of the turbochargers 9 and 10 is realized with the same cooling circulatory systems. Only one thermostat valve 18 is necessary which dependent on the temperature of the internal combustion engine quantitatively controls the return flows of the turbocharger cooling circulations and the cooling circulations of the two cylinder rows. Additionally, also the liquid quantity of a heating circulation 27 is conducted into the thermostat valve 18 which starts from the one collecting pipe 24 to a heat exchanger 28 for heating air for the passenger space and by way of a timing valve 29 serving for the temperature regulation back to the thermostat valve 18.

Vent lines 34, 35, 37, 38 leading to the expansion vessels 13 and 14 are arranged above the liquid level whose level is detected by the indicating devices 32 and 33. The vent lines 34, 35 and 37, 38 are connected together in common lines 36 respectively 39 leading to the inlet connection of the radiator 21 respectively of the thermostat housing 25.

While I have shown and described only one embodiment in accordance with the present invention, it is understood that the same is not limited thereto but is susceptible of numerous changes and modifications as known to those skilled in the art and I therefore do not wish to be limited to the details shown and described herein but intend to cover all such changes and modifications as known to those skilled in the art.

I claim:

1. A cooling system for a multi-cylinder internal combustion engine supercharged by turbocharger means with two opposing cylinder rows and one turbocharger means each for a respective cylinder row, comprising engine cooling circulation means for the internal combustion engine including liquid pump means for effecting a forced flow through said engine cooling circulation means, a turbocharger cooling circulation means operatively connected with said internal combustion engine cooling circulation means, said turbocharger cooling circulation means including connecting line means from the turbocharger means to a geodetically higher expansion vessel means serving as heat exchanger and return line means to the turbocharger means, the flow through said turbocharger circulation means being maintained by thermosiphoning action after the internal combustion engine is turned off, and the pump means being interconnected in the return line means from the expansion vessel means to the turbocharger means;

two cooling circulation means being respectively assigned to the two turbocharger means, the return line means of the turbocharger cooling circulation means terminating in a common pipe section leading to a thermostat valve means and branching off from there into two return line sections leading to the pump means.

2. A cooling system according to claim 1, wherein the pipe lengths and the installed aggregates of the two turbocharger cooling circulation means are dimensioned approximately equal.

3. A cooling system according to claim 2, wherein the circulation means for the two cylinder rows of the internal combustion engine are operatively connected with the return line means of the turbocharger means upstream of the pump means.

4. A cooling system according to claim 3, wherein the cooling liquid flows leaving the two cylinder rows are combined in a thermostat housing of the thermostat valve means, are conducted in a common inlet line to a radiator and from there back to the thermostat valve means and branch off thereat into the return line sections leading to the pump means.

5. A cooling system according to claim 4, wherein the expansion vessel means are plural expansion vessels with bottom portions that are interconnected by lines which are parallel to inlet line means of the turbocharger cooling circulation means, and further comprising vent lines extending from each of said expansion vessels and connected to each other to form common lines which extend to the inlet connection of a radiator and to a thermostat housing of a thermostat valve means respectively.

6. A cooling system according to claim 1, wherein the circulation means for the two cylinder rows of the internal combustion engine are operatively connected with the return line means of the turbocharger means upstream of the pump means.

7. A cooling system according to claim 6, wherein the cooling liquid flows leaving the two cylinder rows are combined in a thermostat housing of the thermostat valve means, are conducted in a common inlet line to a radiator and from there back to the thermostat valve means and branch off thereat into the return line sections leading to the pump means.

8. A cooling system for an internal combustion engine supercharged by turbocharger means, comprising engine cooling circulation means for the internal combustion engine including liquid pump means for effecting a forced flow through said engine cooling circulation means, a turbocharger cooling circulation means operatively connected with said internal combustion engine cooling circulation means, said turbocharger cooling circulation means including connecting line means from the turbocharger means to a geodetically higher expansion vessel means serving as heat exchanger and return line means to the turbocharger means, the flow through said turbocharger circulation means being maintained by thermosiphoning action after the internal combustion engine is turned off, and the pump means being interconnected in the return line means from the expansion vessel means to the turbocharger means;

wherein the expansion vessel means are plural expansion vessels, with bottom portions that are interconnected by lines which are parallel to inlet line means of the turbocharger cooling circulation means, and further comprising vent lines extending from each of said expansion vessels and connected to each other to form common lines to the inlet connection of a radiator and to a thermostat housing of a thermostat valve means respectively.

* * * * *